US010161697B1

(12) United States Patent
Underwood et al.

(10) Patent No.: US 10,161,697 B1
(45) Date of Patent: Dec. 25, 2018

(54) OVERMOLD FIREARM CHARGING HANDLE

(71) Applicant: AXTS, Inc., Salem, OR (US)

(72) Inventors: Joshua A. Underwood, Salem, OR (US); Nicholas James Booras, Salem, OR (US); Ryan Calilung, Santa Ana, CA (US)

(73) Assignee: AXTS, INC., Redmond, OR (US)

( * ) Notice: Subject to any disclaimer, the term of this patent is extended or adjusted under 35 U.S.C. 154(b) by 0 days.

(21) Appl. No.: 15/872,906

(22) Filed: Jan. 16, 2018

(51) Int. Cl.
*F41A 3/72* (2006.01)
*F41A 35/06* (2006.01)
*F41A 3/66* (2006.01)

(52) U.S. Cl.
CPC ..... *F41A 3/72* (2013.01); *F41A 35/06* (2013.01); *F41A 3/66* (2013.01)

(58) Field of Classification Search
CPC ..... F41A 3/72
USPC ..... 89/1.4
See application file for complete search history.

(56) References Cited

U.S. PATENT DOCUMENTS

| | | | |
|---|---|---|---|
| 7,240,600 | B1 | 7/2007 | Bordson |
| 7,832,322 | B1 | 11/2010 | Hoel |
| 7,900,546 | B2 | 3/2011 | Bordson |
| 8,356,537 | B2 | 1/2013 | Kincel |
| D682,373 | S | 5/2013 | Underwood |
| D694,354 | S | 11/2013 | Underwood |
| D705,384 | S | 5/2014 | Underwood |
| D726,860 | S | 4/2015 | Underwood |
| D738,452 | S | 9/2015 | Underwood |
| D770,589 | S | 11/2016 | Underwood |
| D773,587 | S | 12/2016 | Underwood |
| D776,222 | S | 1/2017 | Underwood |
| D779,015 | S | 2/2017 | Underwood |
| D791,900 | S | 7/2017 | Underwood |
| 2018/0080726 | A1* | 3/2018 | Smith ..... F41A 3/72 |

OTHER PUBLICATIONS

Stag Arms Internet Article dated at least Sep. 4, 2017 (see review section); https://www.stagarms.com/stag-15-raptor-lt-ambidextrous-charging-handle-ar15-m16/#reviews (Year: 2017).*

Rainier Arms Raptor by AXTS; Website: https://762ar.com/wp-content/uploads/2013/05/Raptor_Charging_Handle_Animation 1.gif; May 2013.

* cited by examiner

*Primary Examiner* — Reginald S Tillman, Jr.
(74) *Attorney, Agent, or Firm* — Schwabe Williamson & Wyatt, P.C.

(57) ABSTRACT

In some embodiments, an apparatus comprises an overmold charging handle having dimensions including a total length and a total width, wherein the overmold charging handle comprises: a shaft assembly including a first end to insert into a receiver of a firearm and a second end opposite the first end, the second end of the shaft assembly including a head, wherein a width of the head is less than the total width of the overmold charging handle; a latch to prevent movement of the shaft assembly away from the receiver when in a closed position; and a first material-cored handle fastened to the second end of the shaft assembly, the first material-cored handle comprising: an exterior of a second different material, the exterior exposing a section of a recessed core of the first material-cored handle. Other embodiments may be disclosed and/or claimed.

21 Claims, 16 Drawing Sheets

1000

1600

OVERMOLD FIREARM CHARGING HANDLE

BACKGROUND

Typical firearms propel a bullet or other type of projectile through the expansion of gas within a firearm barrel. The majority of the gas may be expelled out of the front of the firearm barrel together with the bullet. However, some firearms may exploit a portion of the gas to automatically cycle the action of the firearm (e.g., "charge" the firearm), which may include ejecting the used casing and reloading another round of ammunition into the firing chamber.

Firearms also may include a charging handle for manually charging the firearm. The charging handle may be used at times such as after loading a magazine—to load the initial round of ammunition from the magazine into the firing chamber. Examples of charging handles are the military specification variants for AR15s and M16, and improvements thereof such as ambidextrous charging handles (e.g., charging handles with a pair of handles to be operated identically with the left or right hand) or improved single-handled charging handles. The ambidextrous charging handles or improved single-handled charging handles may be compatible with AR15/M16 pattern rifles.

DETAILED DESCRIPTION

In some embodiments, an apparatus comprises an overmold charging handle having dimensions including a total length and a total width, wherein the overmold charging handle comprises: a shaft assembly including a first end to insert into a receiver of a firearm and a second end opposite the first end, the second end of the shaft assembly including a head, wherein a width of the head is less than the total width of the overmold charging handle; a latch to prevent movement of the shaft assembly away from the receiver when in a closed position; and a first material-cored handle fastened to the second end of the shaft assembly; the first material-cored handle comprising: an exterior of a second different material, the exterior exposing a section of a recessed core of the first material-cored handle. Other embodiments may be disclosed and/or claimed.

Figure 1A:
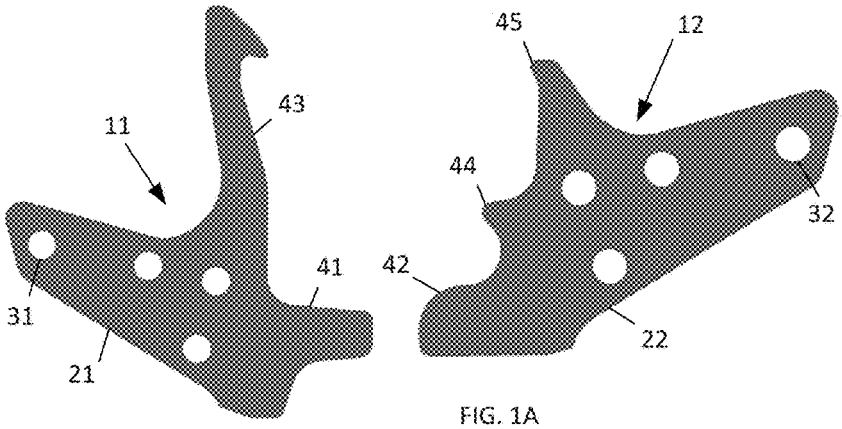
FIG. 1A illustrates a pair of asymmetric cores for an overmold ambidextrous charging handle, according to various embodiments.

FIG. 1A illustrates a pair of asymmetric cores (e.g., a core 11 and a differently-shaped core 12) for an overmold ambidextrous charging handle, according to various embodiments. The core 11 may include a body 21 with a member 41 or other projection extending therefrom. A first side of the member 41 may be to contact with a spring in an ambidextrous charging handle. The core 12 may include a body 22 with a member 42 of other projection extending therefrom. The member 42 may be to contact a second different side of the member 41 to compress the spring. The specific shape of these projections is for example purposes—other shapes may be used.

The cores 11 and 12 may include through holes 31 and 32, respectively. At least one of the through holes 31 and at least one of the through holes 32 may be used to fasten the individual handles (e.g., pivot handles) to an end of a shaft assembly of an ambidextrous charging handle. The other through holes 31 and 32 may be filled with a material (e.g., plastic or any other material suitable for an overmolding process) during an over-molding process. The cores 11 and 12 may be of a different material (e.g., metal).

In various embodiments, the cores 11 and 12 may have additional projections. In some embodiments, the core 11 may have an integrated latch formed from an additional member 43 or other projection, although this is not required (in other embodiments, a latch may be separable component). In some embodiments, the core 12 may have a pair of additional projections (e.g., a member 44 and a member 45). The member 44 may make contact with an auxiliary spring in an ambidextrous charging handle. The member 45 may make contact with a side of an end of a shaft assembly of the ambidextrous charging handle.

Figure 1B:
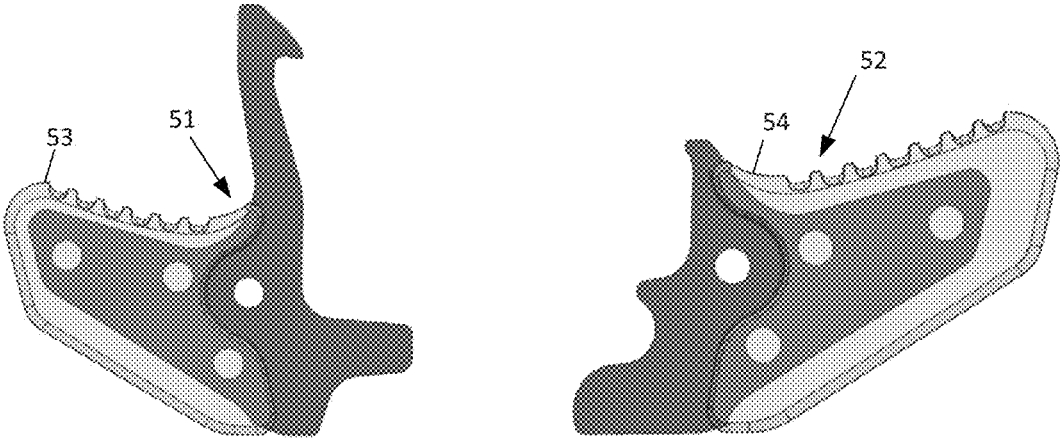
FIG. 1B illustrates a pair of individual handles formed by over-molding the asymmetric cores of FIG. 1A.

FIG. 1B illustrates a pair of individual handles a first individual handle 51 and a second individual handle 52) formed by over-molding the asymmetric cores of FIG. 1A.

The overmold material (e.g., plastic) 53 may expose a section of the first core 11 (FIG. 1A) and the overmold material 54 may expose a differently shaped section of the second core 12 (FIG. 1A).

Figure 1C:
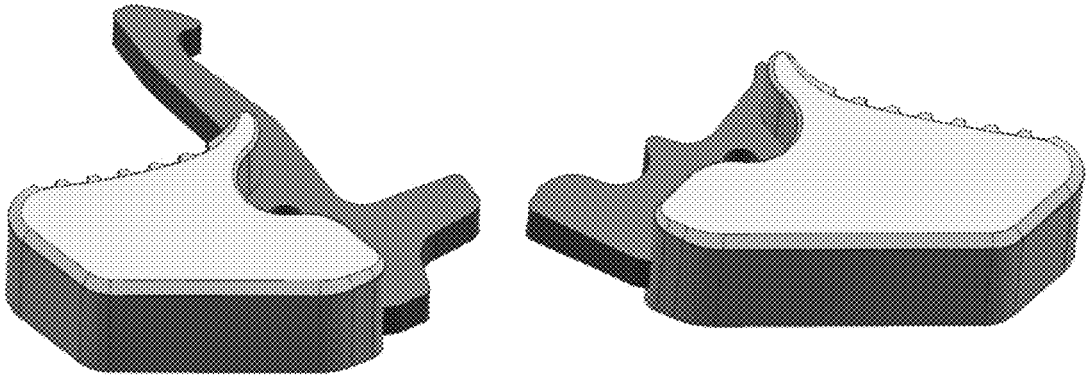
FIG. 1C illustrates an isometric view of the pair of individual handles of FIG. 1B.

The overmold material 53 may fill those through holes 31 (FIG. 1A) that are located on a mounting section of the first core 11. Similarly, the overmold material 54 may fill those through holes 32 (FIG. 1A) that are located on a mounting section of the second core 12. The exterior surface may include serrations formed on an edge to be gripped. FIG. 1C illustrates an isometric view of the individual handles 51 and 52.

The individual handles 51 and 52 may be highly durable and light weight. Furthermore, individual handles 51 and 52 and may be compatible with a wide variety of charging handle shaft assemblies. In some examples, the individual handles 51 and 52 may be used with a same charging handle shaft assembly used for legacy all-metal individual handles, which has a number of advantages such as simplifying inventory.

The individual handles 51 and 52 may also require less material and/or may operate better than some all-metal individual handle. For instance, some all-metal individual handles is may have a design in which an aluminum block is three dimensionally machined to produce a three-dimensional all-metal individual handle to attach to a similar shaft assembly design. In the illustrated embodiment, an aluminum plane may be machined in less dimensions. Accordingly, as compared to an all-metal design based on a single aluminum block, more than one aluminum plane can be constructed with the same amount of aluminum. Also, a planar core may be formed by a variety of methods such as stamping, casting, molding, machining, or the like, or combinations thereof.

As to better operation than some all-metal individual handles, not every all-metal individual handle has such a design—some all-metal individual handle designs may require more than one metal part for an individual handle (such as a lever to be depressed to make movement relative to, say, a left portion of a crossbar). Requirements related to these multicomponent individual metal handles may result in less efficient grip in use than the individual handles 51 and 52 for one or more of the following reasons:

- Stable grip area: Each of the individual handles 51 and 52 may have a fixed grip area regardless of whether the latch is closed or released. This is in contrast to some designs, say the military specification design or other designs in which the grip area is not fixed (the grip area changes depending on which the latch is closed or released, based on a different protrusion of a latch element from the crossbar).
- No moving parts on the grip area—moving parts exposed to a user's hand, of course, may also function non-optimally in field conditions, such as if dirt from a user's hand gets on the exposed lever and gets carried (during lever operation) into the space between the lever and the rest of the charging handle (thus temporarily or permanently changing a resistance required to move the lever or otherwise restricting movement). Also, individual handles 51 and 52 may not pinch a user's hand.
- Versatility in individual handle design: Individual handles 51 and 52 may support more versatility in individual handle design for a number of reasons, such as one or more of the following.
  - Forward angling—forward angled handles are optimal for gripping (avoiding a user's hand slipping off an individual handle). Even in the latch fully open position, the individual handles 51 and 52 may be forward facing (e.g., may form an acute angle with the shaft in the fully released latch position). This may be in contrast to some all-metal designs that may be forward-facing only in some latch states, say the latch closed state.
  - Individual handles 51 and 52 may have a larger grip area than some all-metal multicomponent designs, which may require a crossbar and a gap in the crossbar from which a latch element may protrude.
  - Individual handles 51 and 52 may also provide versatility in grip feature design related to the overmold material exterior. For instance, Referring to FIG. 1B, grip features may include serrations defined by many smooth C-shape openings (C-shaped serrations are shown in FIG. 1B, for instance). These serrations are in contrast to some multi-component individual metal handles in which few rough V-shaped cuts may be formed on the latch element by machining.

Figure 2:
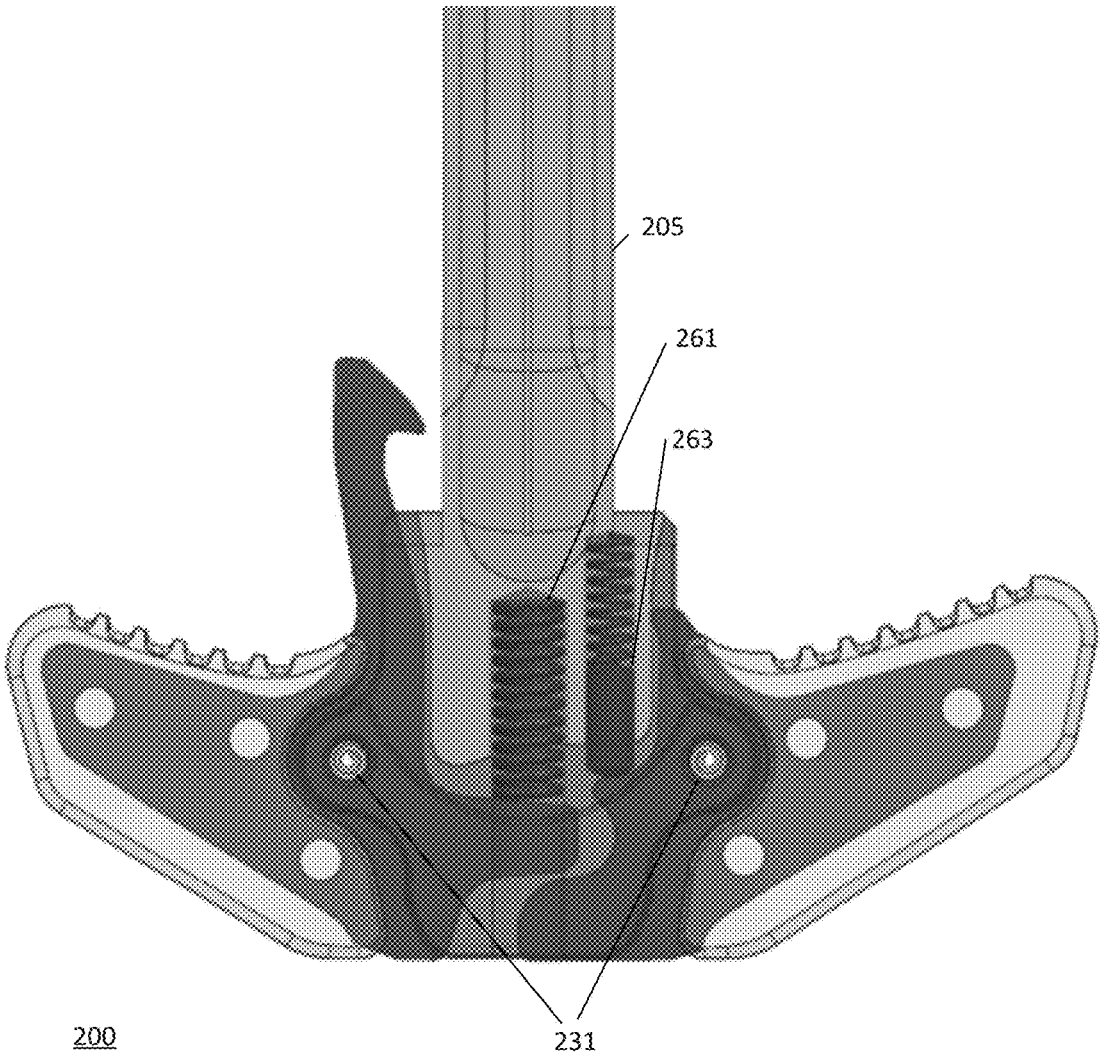
FIG. 2 illustrates an overmold ambidextrous charging handle, according to various embodiments.

FIG. 2 illustrates an overmold ambidextrous charging handle 200, according to various embodiments. The overmold ambidextrous charging handle 200 may include a shaft assembly 205 having a front end to insert in an upper receiver of a firearm (not shown) and a rear end having a narrow head (e.g., having a width less (e.g., substantially less) than the total width of the charging assembly 200). The individual handles 51 and 52 of FIG. 1B may be fastened (e.g., pivotably attached) to the shaft assembly 205 (e.g., the head) using fasteners 231 (e.g., roll pins). The fasteners 231 may be connected through those through holes 31 and 32 (FIG. 1A) that are in a region to be exposed by the overmold material 53 and 54 (FIG. 1B illustrates the region exposed by the overmold material 53 and 54, and the exposed through holes 31 and 32).

As explained previously, any of the individual handles described herein may be compatible with the same ambidextrous charging handle shaft assembly used for some all-metal individual handles. The overmold ambidextrous charging handle 200 is illustrated with the latch in the closed state. The firearm is not shown—in the closed state the latch may releasable, couple to a firearm housing to prevent the charging handle 200 from being pulled rearward unless the latch is released.

In this embodiment, a front side of the member of the left individual handle is in contact with the spring 261 to urge the member of the left individual handle in the clockwise position to hold the latch closed. When a user pulls the left individual handle rearward, the user overcomes the spring 261 to rotate the left individual handle in the counterclockwise direction to release the latch. When a user pulls the right individual handle rearward, a member of the right individual handle may push the rear side of the member of the left individual handle forward to impart a corresponding rearward motion to the left individual handle.

In this embodiment, the right individual handle includes a pair of additional members with one member that is in contact with an auxiliary spring assembly 263 to urge the right individual handle in a counterclockwise direction. The other additional member of the pair of additional members may make contact with the shaft assembly 205 to keep a position of the right individual handle in symmetry with a position of the left individual handle in the closed latch state. The pair of additional members may be used to provide a gap between the member of the left individual handle and the member of the right individual handle in the rest state.

As illustrated in FIG. 2, the individual handles may be different sizes. For instance, the individual handle on the right side of the charging handle 200 may be longer than the other individual handle (as shown) to provide clearance with respect to right-side structures of a firearm to receive the firearm charging handle 200.

Figure 3:
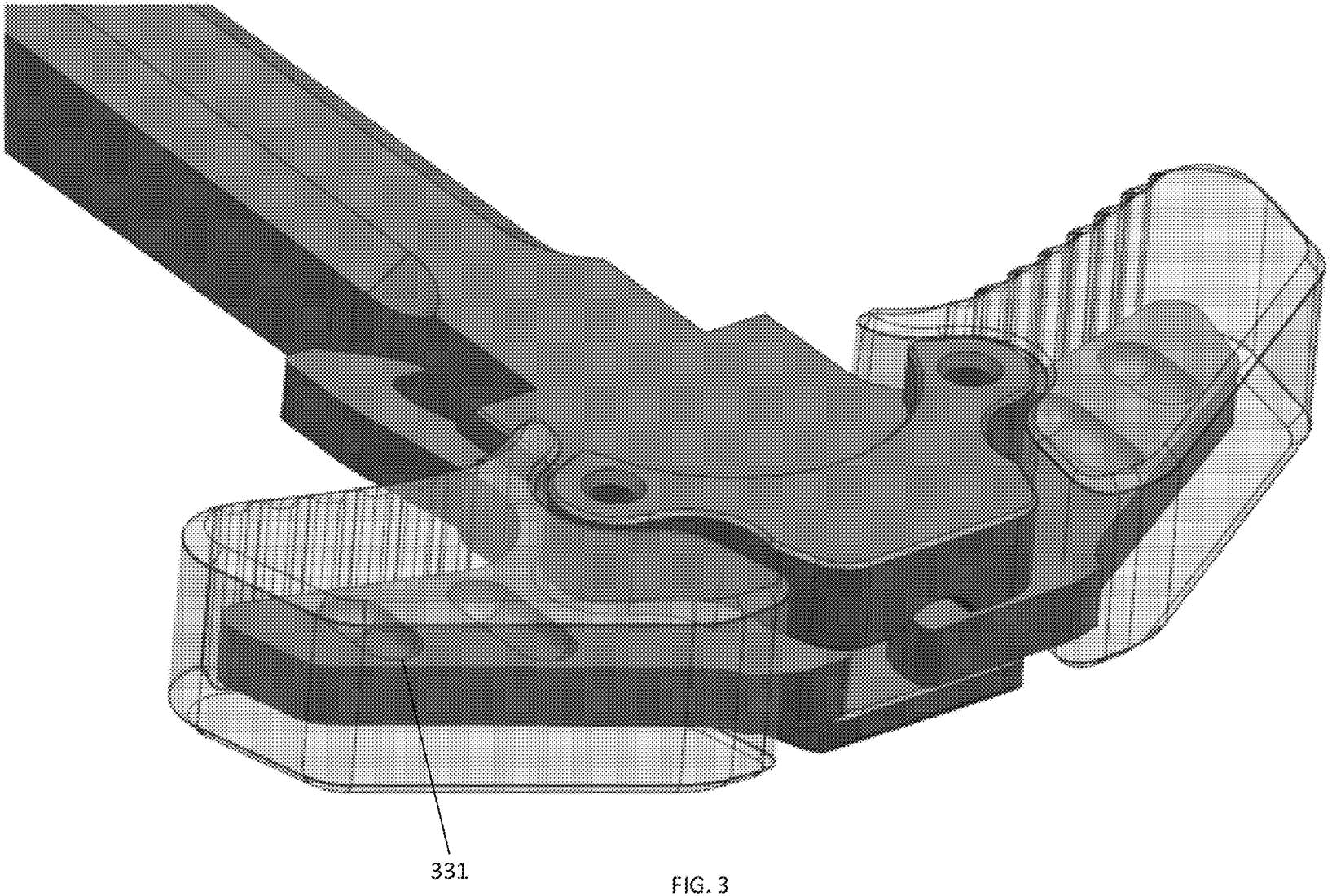
FIG. 3 illustrates an isometric view of another overmold ambidextrous charging handle having grooves formed on surfaces of planar mounting section of the cores.

FIG. 3 illustrates an isometric view of another overmold ambidextrous charging handle having grooves 331 formed on surfaces of planar mounting section of the cores. The grooves 331 have a shape of a half-spherocylinder in the illustration, but other shapes may be used for grooves 331 in other embodiments. In other embodiments, the grooves 331 may be on other locations besides planar surfaces of a planar mounting section, say along edges. Also, in other embodiments, grooves 331 may be used with any mounting section (not limited to planar mounting sections). Other embodiments may include only one groove 331 per core.

Figure 4:
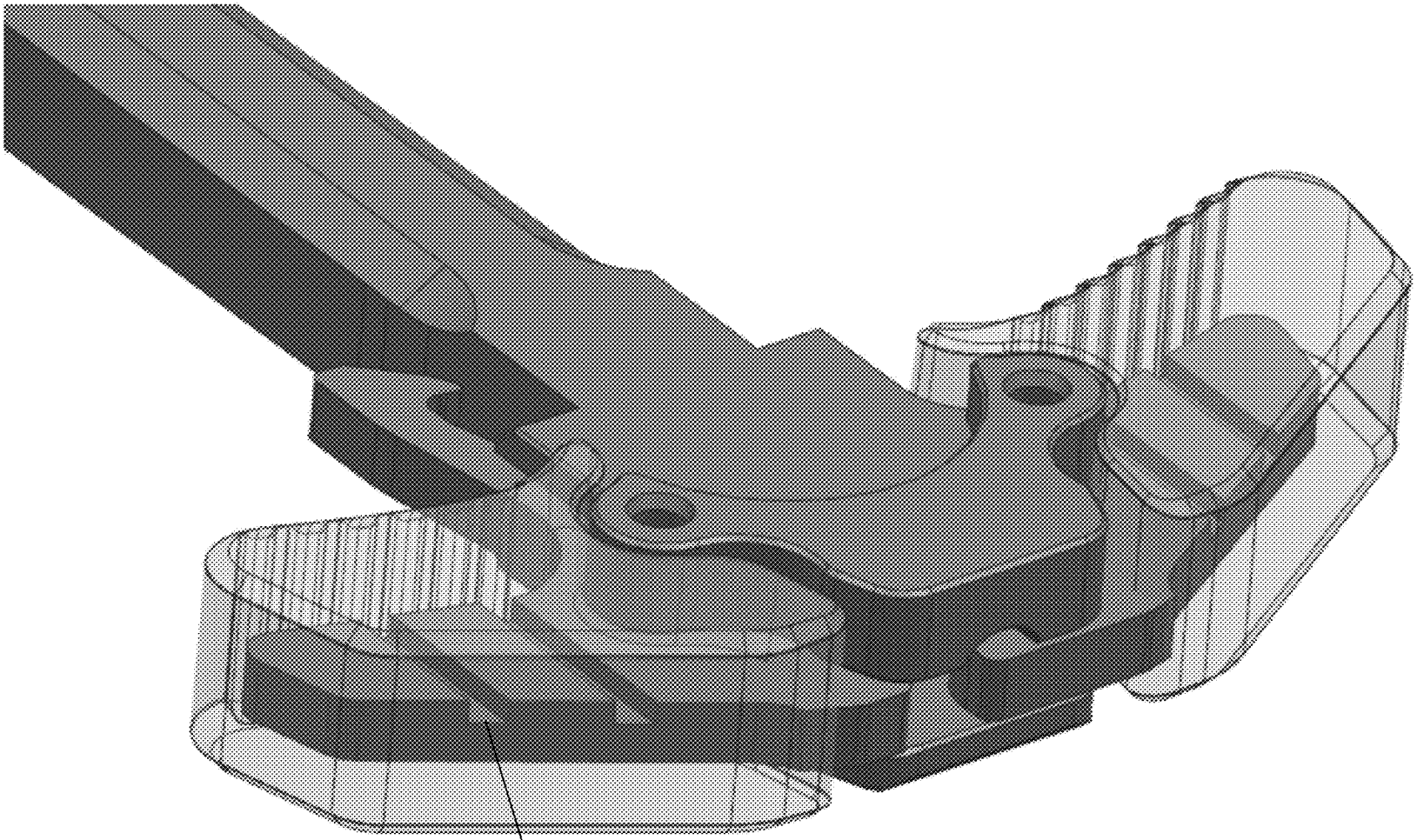
FIG. 4 illustrates an isometric view of yet another overmold ambidextrous charging handle having channels formed on surfaces of planar mounting sections of the cores.

FIG. 4 illustrates an isometric view of yet another overmold ambidextrous charging handle having channels 431 formed on surfaces of planar mounting sections of the cores. In the illustration, the channels 431 are parallel with the shaft, but in other examples the channels 431 may be in other directions such as orthogonal to the front or rear edge of the mounting sections. Other embodiments may include only one channel 431 per core.

Figure 5:
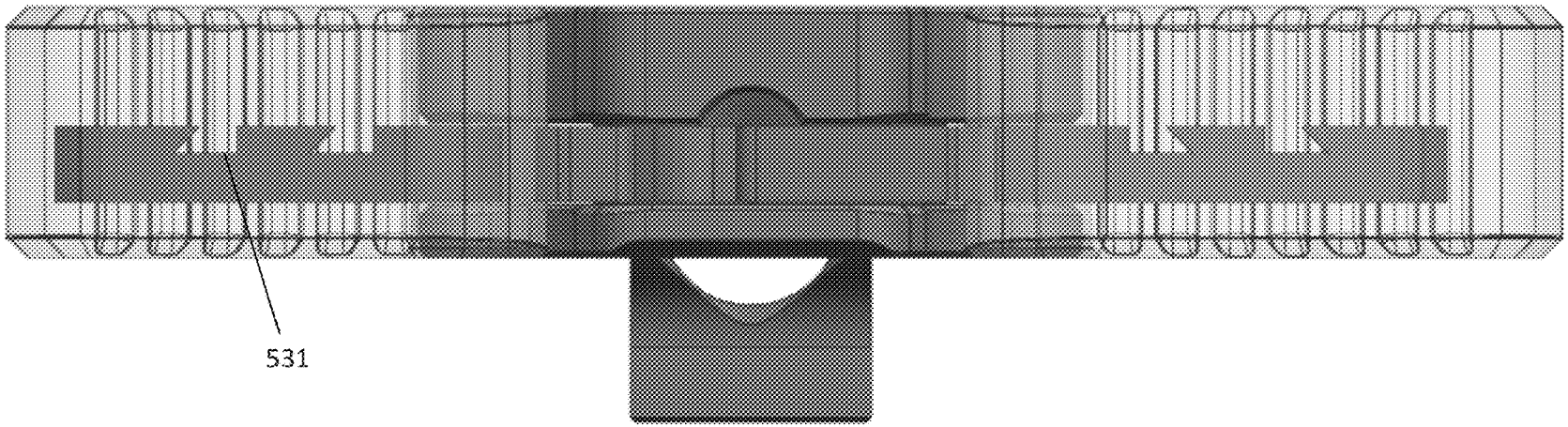
FIG. 5 illustrates a front end view of yet another overmold ambidextrous charging handle having dovetail channels formed on surfaces of planar mounting sections of the cores.

Also, the channels 431 may be in any shape (in the illustration they have vertical sidewalls, but can include one or more non-verticals sidewalls in other examples). FIG. 5 illustrates a front-end view of yet another overmold ambidextrous charging handle having dovetail channels 531 formed on surfaces of planar mounting sections of the cores. In this example, one sidewall is vertical, and the other sidewall is non-vertical. In other embodiments, both sidewalls may be non-vertical. Other embodiments may include only one dovetail channel 531 per core.

Figure 6:
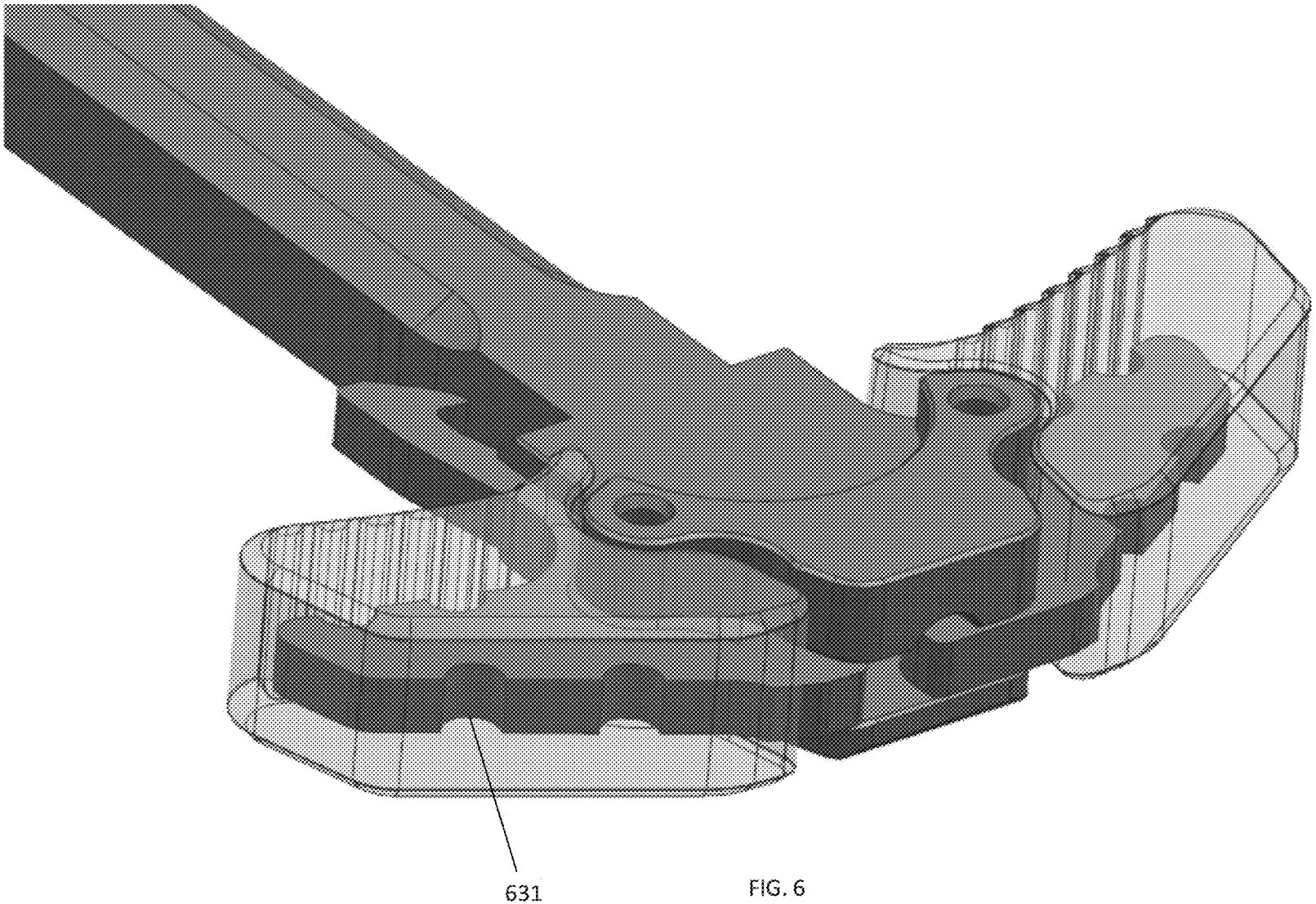
FIG. 6 illustrates an isometric view of yet another overmold ambidextrous charging handle having notches formed on edges of planar mounting sections of the cores.

FIG. 6 illustrates an isometric view of yet another overmold ambidextrous charging handle having notches 631 formed on edges of planar mounting sections of the cores. The notches 631 are illustrated as having a shape of a half-cylinder but other shapes may be used for notches 631 in other examples.

Figure 7A:
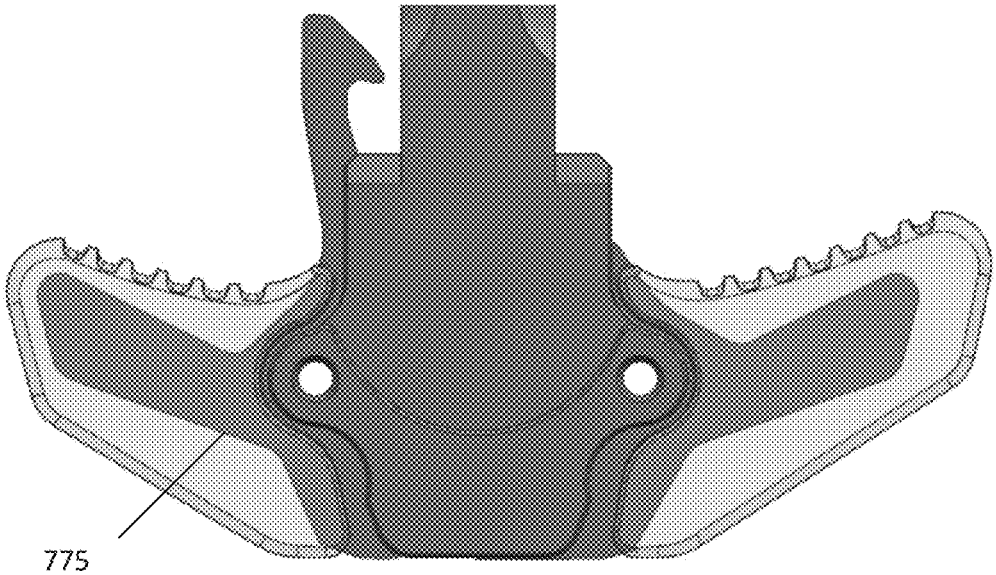
FIGS. 7A-B illustrates yet further overmold ambidextrous charging handles in which each of the planar mounting sections of the cores is recessed to define a neck.
Figure 7B:
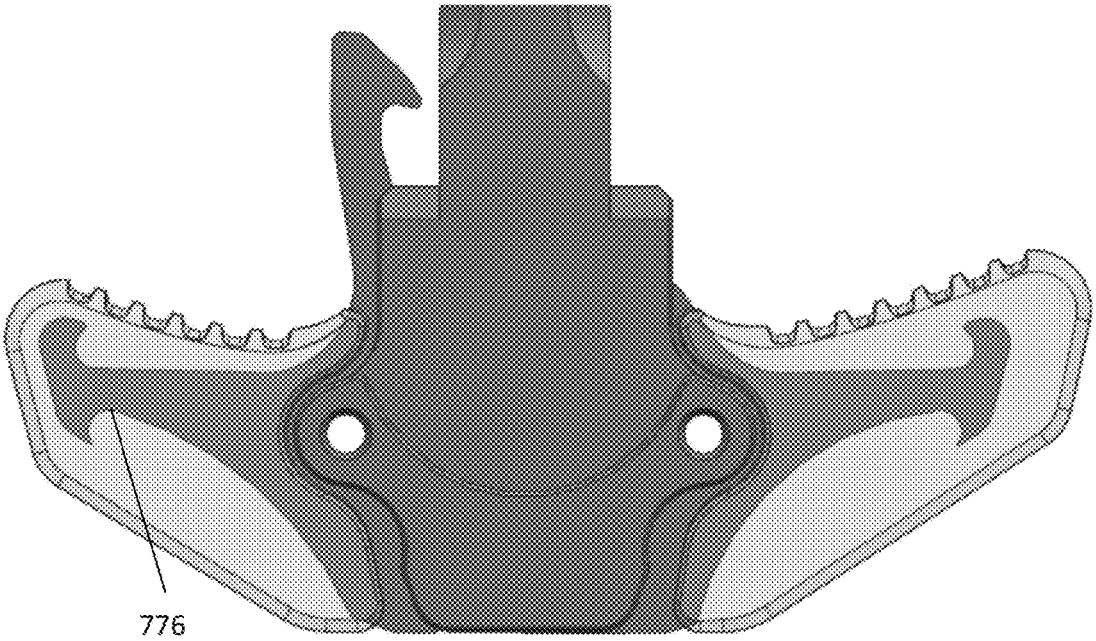

FIGS. 7A-B illustrates yet further overmold ambidextrous charging handles in which each of the planar mounting sections of the cores is recessed to define necks 775 and 776, respectively. The neck 775 is located proximate to a first end of the planar mounting section, while the neck 776 is proximate to a second different end of the planar mounting section. Neck 775 may be recessing to form triangular openings in front and rear edges of the planar mounting sections. Other shapes can be used in other examples. Neck 776 may be formed by recessing an opening with a recurve profile in the front and rear edges of the planar mounting sections. Other profiles can be used in other examples.

Figure 8:
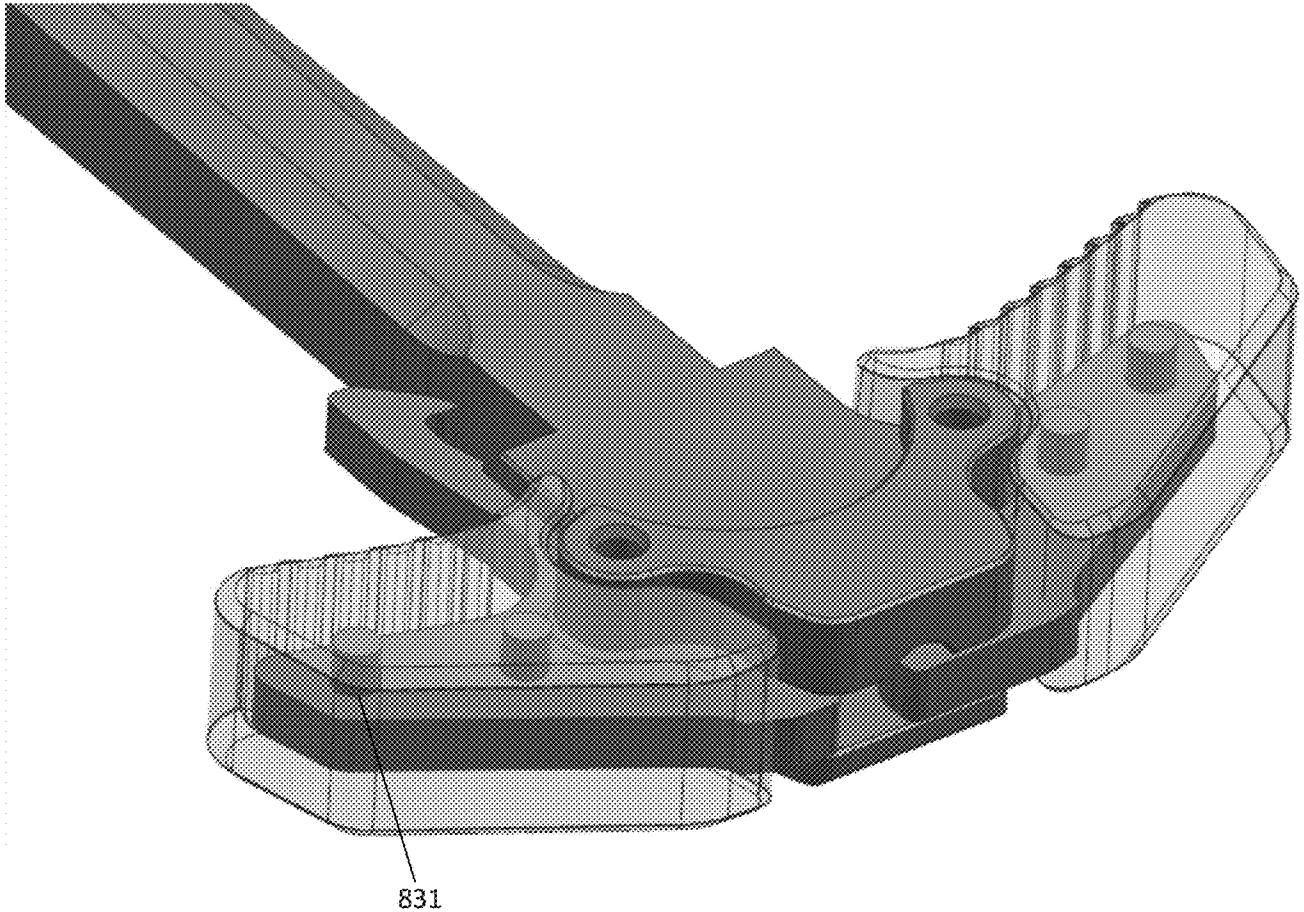
FIG. 8 illustrates an isometric view of yet another overmold ambidextrous charging handle in which each mounting section of the cores is recessed to define posts.

FIG. 8 illustrates an isometric view of yet another overmold ambidextrous charging handle in which each mounting section of the cores is recessed to define posts 831. In this example, a surface of the mounting section may be recessed to leave a remainder extending away from the surface. The shape of the remainder (e.g., post 831) is a cylindrical column in this embodiment, but any shape can be used for a post 831 (such as with a conical shape, either widening away from the mounting section or narrowing away from the mounting section). Also, in this illustration the cylinder has no non-vertical sections (e.g., a continuous vertical sidewall in the case of a cylinder shape).

Figure 9:
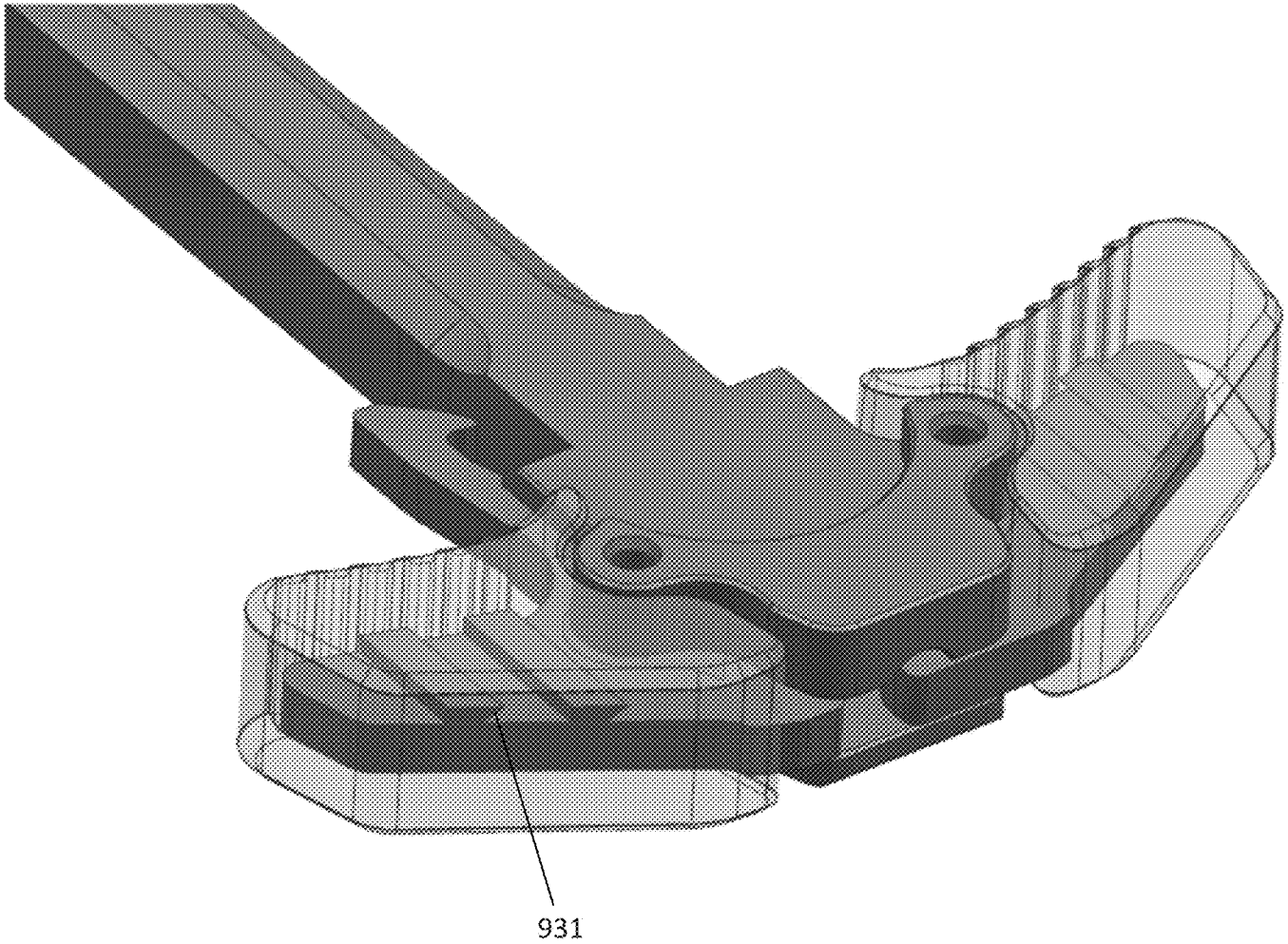
FIG. 9 illustrates an isometric view of yet another overmold ambidextrous charging handle in which each mounting section of the cores is recessed to define dovetail ribs.

FIG. 9 illustrates an isometric view of yet another overmold ambidextrous charging handle in which each mounting section of the cores is recessed to define projections having a non-vertical sidewall, e.g., dovetail ribs 931. Other embodiments may include only one dovetail rib 931 per core.

Figure 10:
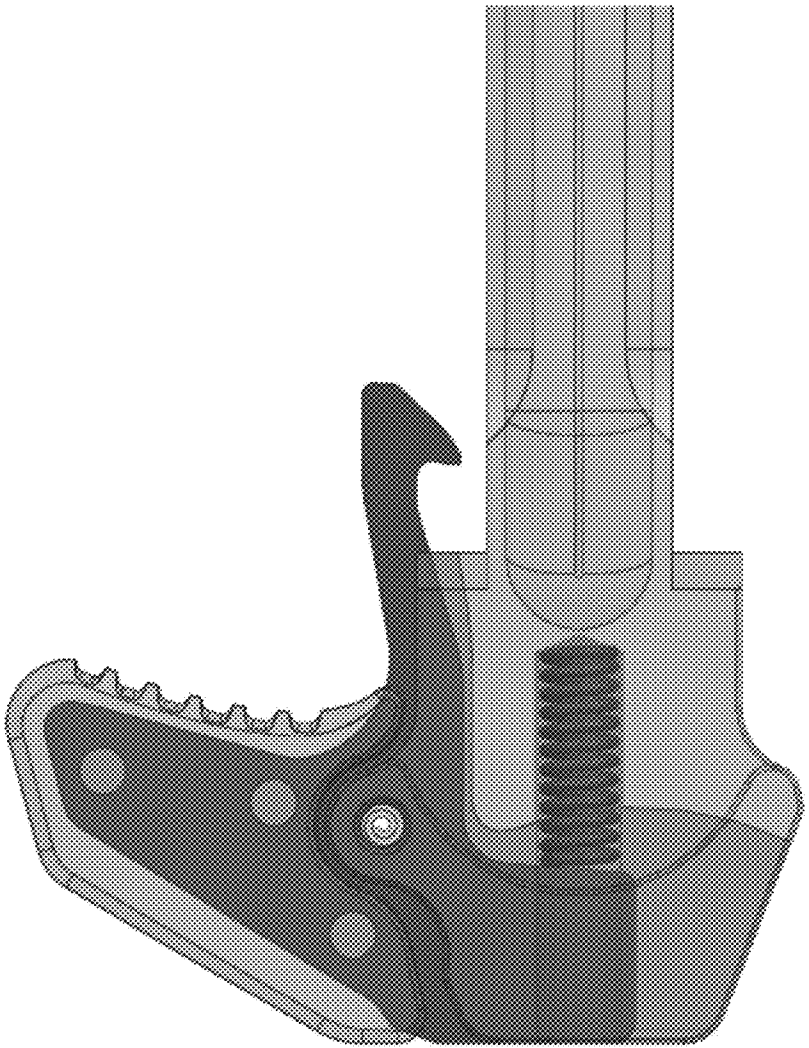
FIG. 10 illustrates a charging handle with a single individual handle, according to various embodiments.
Figure 11A:
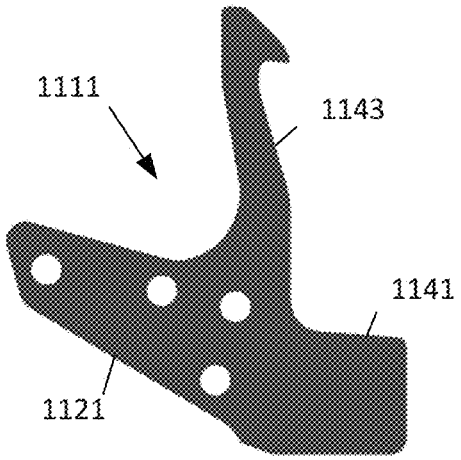
FIGS. 11A-C illustrate, respectively, a core of the charging handle of FIG. 10, an individual handle formed by over-molding the core, and an isometric view of the individual handle, according to various embodiments.
Figure 11B:
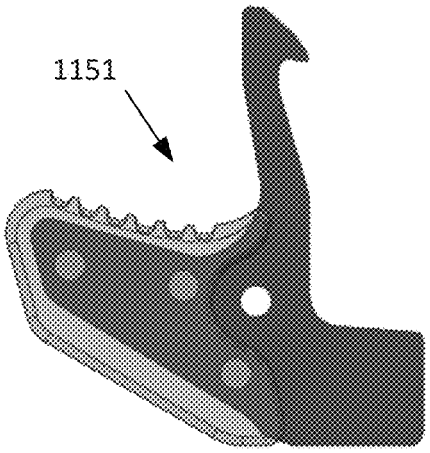
Figure 11C:
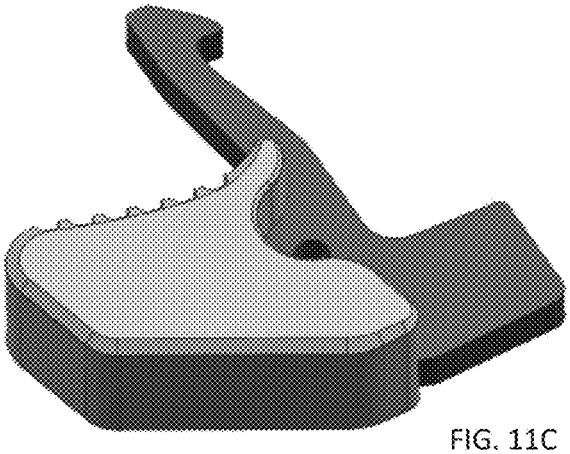

FIG. 10 illustrates a charging handle 1000 with a single individual handle, according to various embodiments. The charging handle 1000 includes an asymmetric end (e.g., a narrow asymmetric head) with a single core fastened to one side of the asymmetric end. FIGS. 11A-C illustrate, respectively, a core 1111 of the charging handle 1000 of FIG. 10, an individual handle 1151 formed by over-molding the core 1111, and an isometric view of the individual handle 1151, according to various embodiments. The single core 1111 includes a body 1121 having a first member 1141 and a second member 1143 to define a latch. The first member 1141 may contact a spring to urge the core 1111 in the clockwise direction to hold the latch in a closed state. The single individual handle 1151 may be pulled rearward to release the latch.

Referring again to FIG. 10, in this embodiment, the side opposite the single individual handle is truncated. In other embodiments of a charging handle with a single individual handle, this side may include a fixed projection, such as a portion of a crossbar.

Figure 12:
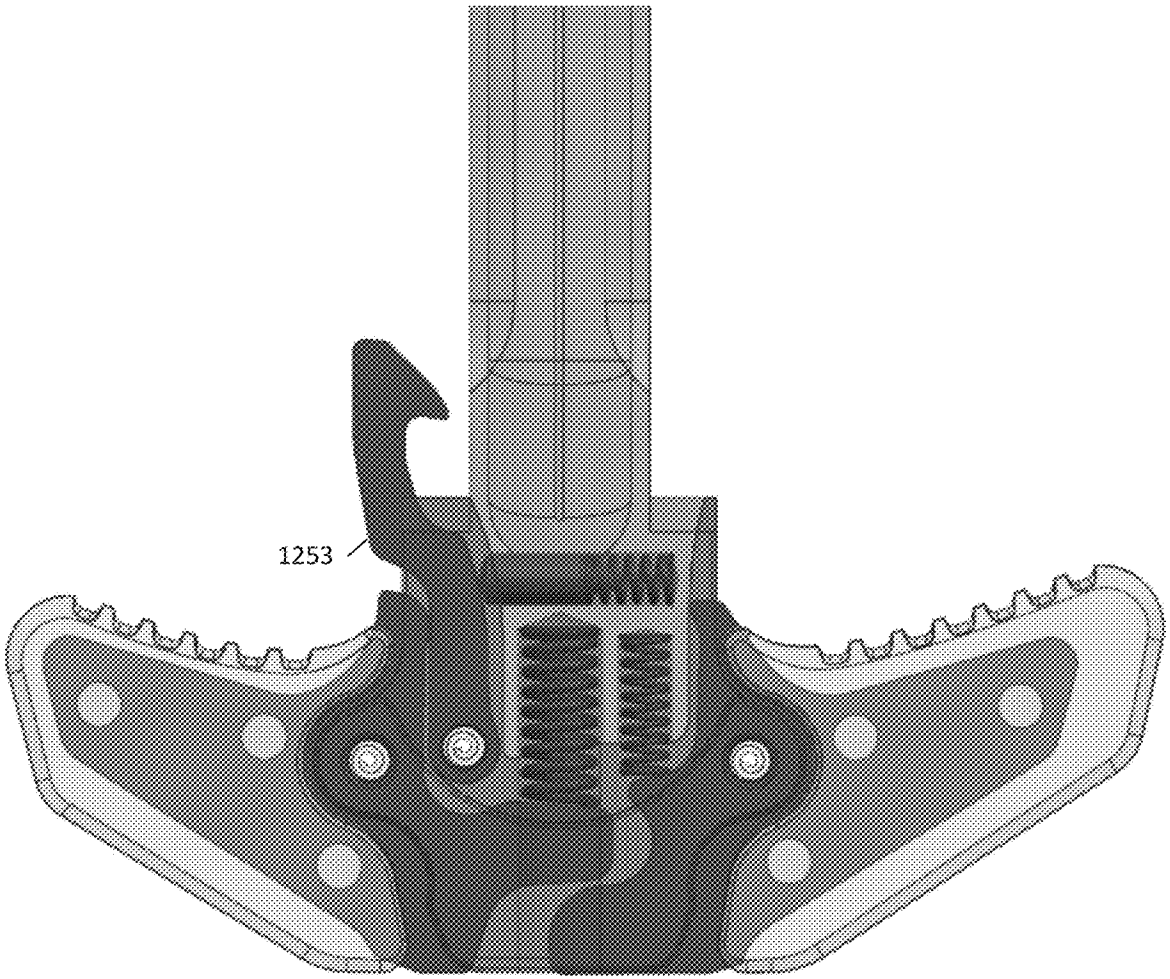
FIG. 12 illustrates another overmold ambidextrous charging handle, according to various embodiments.

FIG. 12 illustrates another overmold ambidextrous charging handle 1200, according to various embodiments. In contrast to other embodiments in which a member protruding from a body of the core may define the latch (e.g., an integrated latch), in this embodiment the latch 1253 may be separately attached to a shaft assembly. For instance, the latch 1253 includes a through hole having a different axis than a through hole in the core. The latch may move relative to the core by operation the main spring and the orthogonally oriented auxiliary spring.

Figure 13A:
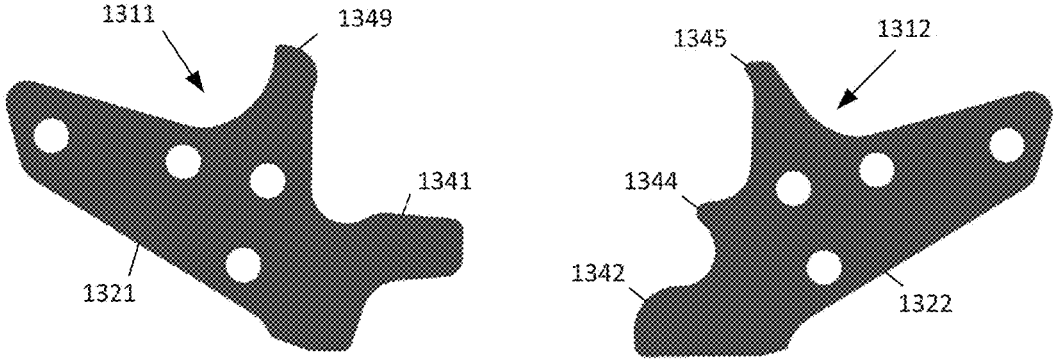
FIGS. 13A-C illustrate, respectively, a pair of asymmetric cores of the overmold ambidextrous charging handle of FIG. 12, a pair of individual handles formed by the asymmetric cores to operate a latch, and an isometric view of the pair of individual handles, according to various embodiments.
Figure 13B:
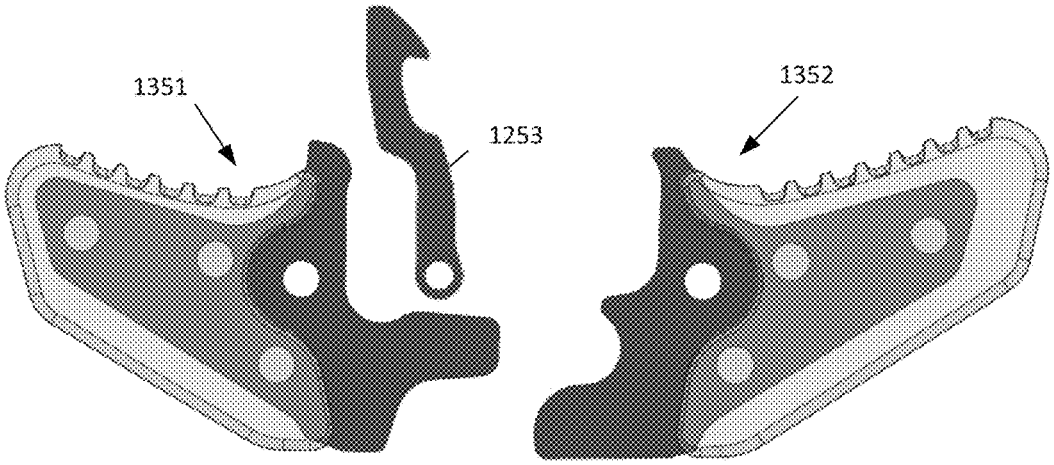
Figure 13C:
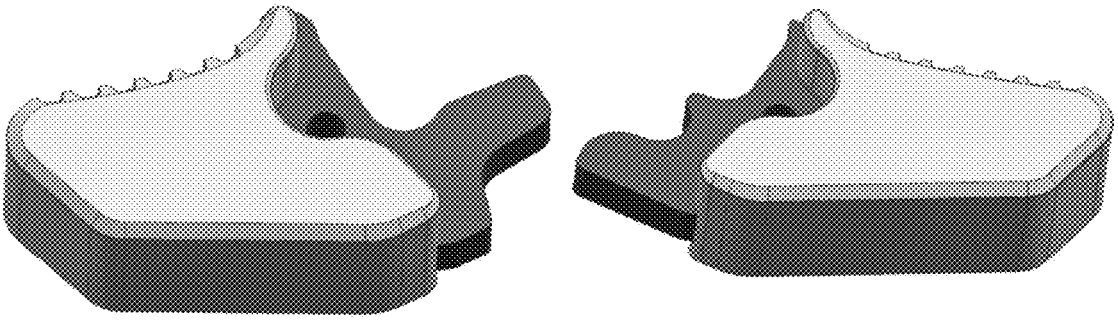

FIGS. 13A-C illustrate, respectively, a pair of asymmetric cores 1311 and 1312 of the overmold ambidextrous charging handle 1200 of FIG. 12, a pair of individual handles 1351 and 1352 formed by the asymmetric cores 1311 and 1312 to operate the latch 1253 (FIG. 12), and an isometric view of the pair of individual handles 1351 and 1352, according to various embodiments. The core 1312 may include body 1322 and members 1342, 1344, and 1345, which may be similar to body 22 and members 42, 44, and 45 (FIG. 1A), respectively. The core 1311 may include body 1321 and member 1341, which may be similar to body 21 and member 41 (FIG. 1A), respectively.

Member 1349 may be arranged to contact a back of the latch 1253. This contact, given that the spring arrangement (FIG. 12) urges the core 1311 in the clockwise direction, may keep latch 1253 (FIG. 12) in a closed position (latch 1253 may be arranged to spring out due to the spring configuration illustrated in FIG. 12) until the individual handle 1351 is moved rearward (by pulling the individual handle 1351 rearward and/or pulling the individual handle 1352 rearward).

Figure 14:
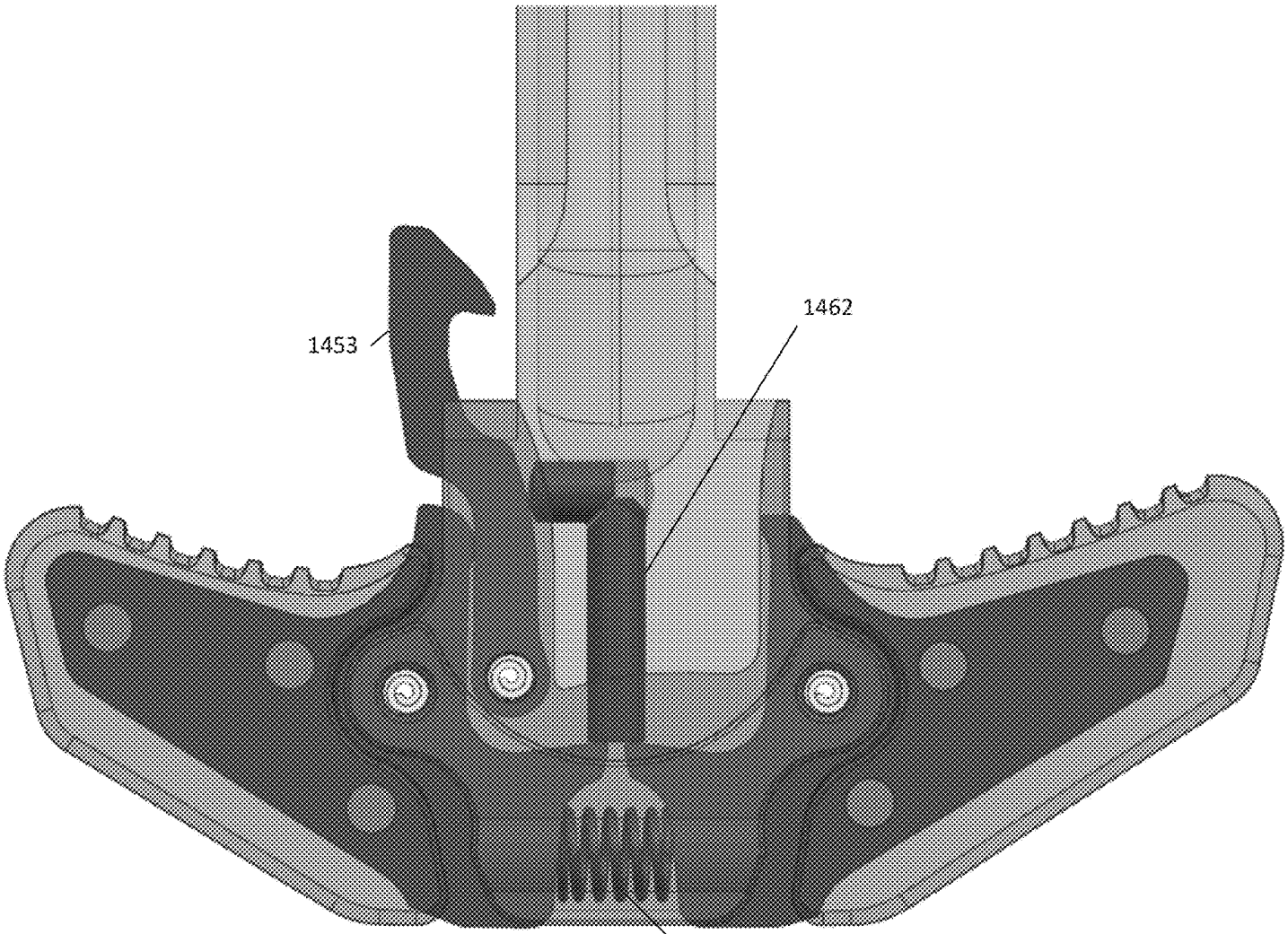
FIG. 14 illustrates yet another overmold ambidextrous charging handle, according to various embodiments.

FIG. 14 illustrates yet another overmold ambidextrous charging handle 1400, according to various embodiments. In this embodiment, each core may include a member with a surface to contact one of the ends of a spring 1461 (in one example, at least one of these surfaces may define an opening to mount one end of the spring 1461, but this is not required as the head may define a passage or other structure to mount the spring 1461).

In this arrangement, the spring 1461 may urge the left individual handle clockwise, which may keep the latch 1453 closed. The latch 1453 may be in contact with a plunger arrangement 1462 to be operated to release the latch 1453 by pulling one or both of the individual handles rearward. Also, in this embodiment, the left individual handle may be moved (relative to the shaft assembly) without imparting movement on the right individual handle (although when the right individual handle is pulled movement is imparted on the left individual handle by the back of the latch 1453). Also, similar to the embodiment of FIG. 12, the latch 1453 includes a through hole having a different axis than a through hole in the core.

Figure 15A:
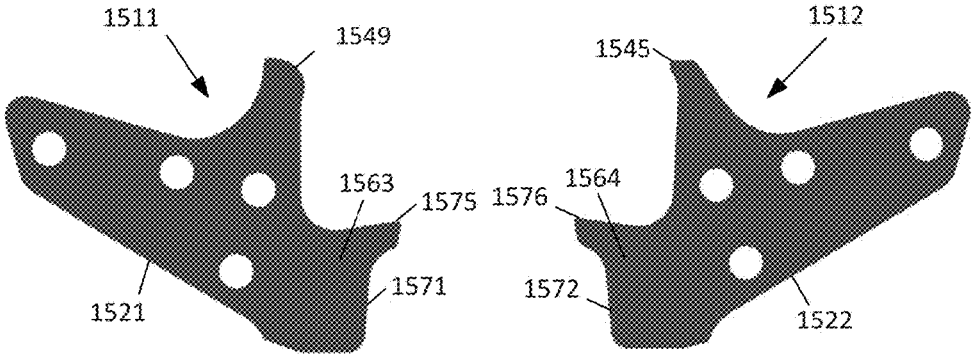
FIGS. 15A-C illustrate, respectively, a pair of cores of the overmold ambidextrous charging handle of FIG. 14, a pair of individual handles formed by the cores to operate a latch, and an isometric view of the pair of individual handles, according to various embodiments.
Figure 15B:
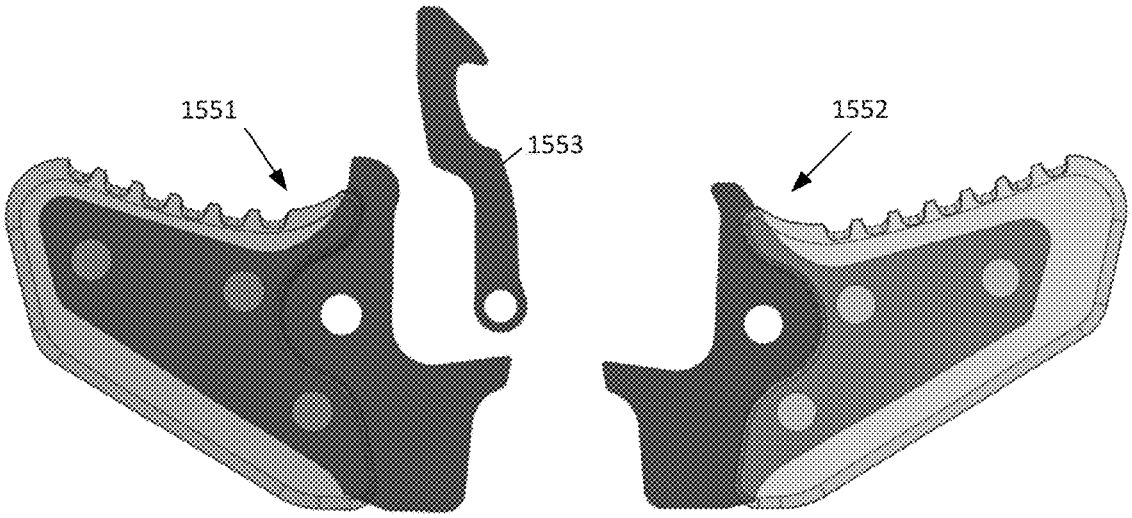
Figure 15C:
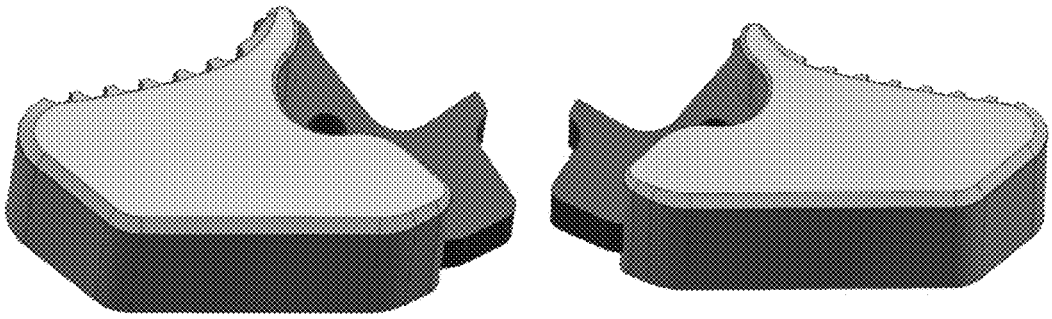

FIGS. 15A-C illustrate, respectively, a pair of cores 1511 and 1512 of the overmold ambidextrous charging handle 1400 of FIG. 14, a pair of individual handles 1551 and 1552 formed by the cores 1511 and 1512 to operate the latch 1553, and an isometric view of the pair of individual handles 1551 and 1552, according to various embodiments. The core 1511 may include body 1521 and member 1549, similar to body 1321 and member 1349 (FIG. 13), respectively. The core 1512 may include body 1522 and member 1545, similar to body 1322 and member 1345 (FIG. 13), respectively.

The cores 1511 and 1512 may include, respectively, members 1563 and 1564, which may have symmetric shapes. The member 1563 may include a surface 1571 to contact one end of the spring 1461 (FIG. 14) and the member 1564 may include a corresponding surface 1572 to contact the other end of the spring 1461. The members 1563 and 1564 may also include surfaces 1575 and 1576, respectively, to contact a plunger of the plunger arrangement 1462 (FIG. 14).

Figure 16:
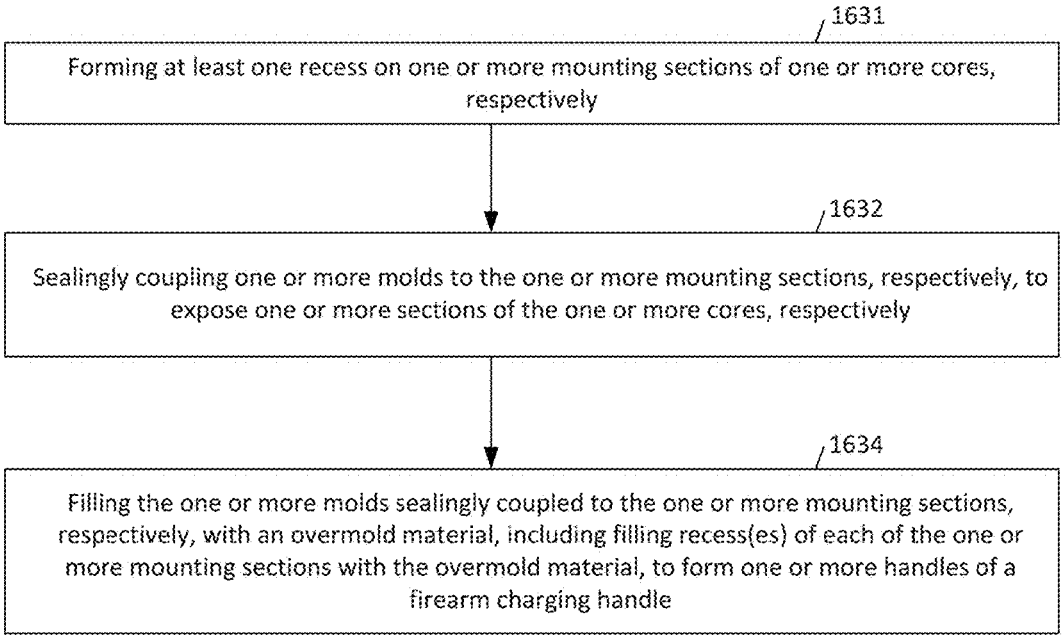
FIG. 16 illustrates a process of fabricating any overmold ambidextrous charging described herein.

FIG. 16 illustrates a process 1600 of fabricating any overmold charging described herein. In block 1631, at least one recess may be formed on one or more mounting sections of one or more cores, respectively. In one example, the recesses may be drill holes and the same process used to make drill holes for mounting the individual handle to the shaft assembly of the charging handle may be used for recessing. For instance, all the drill holes may be formed by drilling using a same tool and/or a same size bit. In other examples, the through hole(s) to be used for fastening may be drill holes but the other through holes (to be filled with the plastic or other material) may be any opening such as a window recessed from the core (the window may be larger than the drill hole, and may be any shape such as a triangular through hole, a square through hole, or the like, or combinations thereof).

In other examples, a different process may be used to form the recesses in the mounting section than the through holes for mounting the individual handles to the shaft assembly of the charging handle, and the mounting section may or may not be completely planar. In completely planar mounting sections, recesses may be formed on the planar surfaces or the edges of the planar surfaces. In other mounting sections, the surface may be recessed to leave a remainder, such as a post, protruding from a planar region of the mounting section.

In block 1632, one or more molds may be sealingly coupled to the one or more mounting sections, respectively, to expose one or more sections of the one or more cores, respectively. In ambidextrous charging handles with differently sized individual handles, a first mold with a first mold interior may be used for the right individual handle and a second mold with a second mold interior may be used for the left individual handle. The mold(s) may be formed from pieces applied from more than two directions (e.g., four directions) to avoid leaving a seam on a selected location (such as on the serrated region and/or a rest of an edge of the individual handle).

In block 1634, the one or more molds may be sealingly coupled to the one or more mounting sections, respectively, may be filled with an overmold material, including filling recess(es) of each of the one or more mounting sections, to form one or more handles of the firearm charging handle. The mold(s) may be filled with the overmold material using injection over-molding onto the recessed mounting sections of the cores. Under pressure, the overmold material may flow into the mold interior(s) onto the mounting sections including into the recesses, thus capturing the mounting sections inside the overmold material in a strong bond.

One embodiment is a method of manufacturing one or more handles of a firearm charging handle from one or more metal cores, respectively, the method comprising: forming at least one recess on each of one or more mounting sections of the one or more metal cores, respectively: sealingly coupling one or more molds to the one or more mounting sections, respectively, to expose one or more sections of the one or more metal cores, respectively; and filling the one or more molds sealingly coupled to the one or more mounting sections, respectively, including filling the at least one recess of each of the one or more mounting sections, to form the one or more handles.

One embodiment is a plastic overmold charging handle, comprising: a shaft assembly including a first end to insert into a receiver of a firearm and a second end opposite the first end; a latch to prevent movement of the shaft assembly away from the receiver when in a closed position; a single metal-cored handle fastened to the second end of the shaft, the single metal-cored handle comprising: a plastic exterior that exposes a section of a metal core of the single handle; and one or more through holes located on both sides of a border between the exposed section of the metal core and a remainder of the metal core.

One embodiment is a method of manufacturing a handle of a firearm charging handle from a metal core, wherein the metal core includes a body having a member to urge the body in a clockwise or counterclockwise direction to hold a latch associated with the body in a closed position, the method comprising: forming one or more recesses on the body; sealingly coupling a mold defining a mold interior to a portion of the body to expose the member; and filling the mold sealingly coupled to the portion of the body with plastic, including filling the one or more recesses on the body, to form the handle on the portion of the body.

In this embodiment, the firearm charging handle may comprise an ambidextrous charging handle; the handle may comprise one handle of a pair of handles of the ambidextrous charging handle; and the metal core comprises a first core of a plurality of metal cores, the body comprises a first body, the member comprises a first member, the mold interior comprises a first mold interior, wherein a second core of the plurality of metal cores includes a second body having a second member to release the latch, and the method further comprises: forming one or more recesses on the second body; sealingly coupling the mold or a different mold defining a second mold interior to a portion of the second body to expose the second member; and filling the mold sealingly coupled to the portion of the second body with plastic, including filling the one or more recesses on the second body, to form the other handle of the pair on the portion of the second body. Forming one or more recesses on the first body and forming one or more recesses on the second body may further comprise: forming one or more first cavities on a surface of the portion of the first body prior to filling the mold sealingly coupled to the portion of the first body with the plastic; forming one or more second cavities on a surface of the portion of the second body prior to filling the mold sealingly coupled to the portion of the second body with the plastic. The one or more first cavities comprise a first groove or channel, and the one or more second cavities comprise a second groove or channel. The one or more first cavities may comprise a dovetail channel, and wherein the one or more second cavities comprise a dovetail channel. The first body may comprise a first planar body and the second body comprises a second planar body, and wherein at least one first cavity of the one or more first cavities is formed on an edge of the portion of the first planar body and at least one second cavity of the one or more second cavities is formed on an edge of the portion of the second planar body. At least one first cavity forms a neck of the portion of the first planar body, and wherein the at least one second cavity forms a neck of the portion of the second planar body. The one or more first cavities may comprise a plurality of first notches, and the one or more second cavities comprise a plurality of second notches.

In some embodiments; the one or more recesses on the first body define at least one first protrusion on a surface of the portion of the first body, and wherein the one or more recesses on the second body define at least one second protrusion on a surface of the portion of the first body. The first and second protrusions may comprise columns. The first and second protrusions may comprise first ends proximate to the first and second body and second larger ends opposite the first ends.

Some embodiments may include forming a through hole in a region of the first body exposed by the mold sealingly coupled to the first body or in a region of the first body to be exposed by the mold to be sealingly coupled to the first body; forming a through hole in a region of the second body exposed by the mold sealingly coupled to the second body or in a region of the first body to be exposed by the mold to be sealingly coupled to the second body; the through holes for fastening the handles to a head of an end of a shaft of the ambidextrous charging handle.

Having described and illustrated various examples herein, it should be apparent that other examples may be modified in arrangement and detail. We claim all modifications and variations coming within the spirit and scope of the following claims.

The invention claimed is:

1. A method of manufacturing a handle of a firearm charging handle from a core of a first material, wherein the core includes a body having a member to urge the body in a clockwise or counterclockwise direction to hold a latch associated with the body in a closed position, the method comprising:

forming one or more recesses on the body;

sealingly coupling a mold defining a mold interior to a portion of the body to expose the member; and filling the mold sealingly coupled to the portion of the body with a second material that is different than the first material, including filling the one or more recesses on the body, to form the handle on the portion of the body.

2. The method of claim 1, wherein:

the firearm charging handle comprises an ambidextrous charging handle;

the handle comprises one handle of a pair of handles of the ambidextrous charging handle; and the core comprises a first core of a plurality of cores of the first material, the body comprises a first body, the member comprises a first member, the mold interior comprises a first mold interior, wherein a second core of the plurality of cores includes a second body having a second member to release the latch, and the method further comprises:

forming one or more recesses on the second body;

sealingly coupling the mold or a different mold defining a second mold interior to a portion of the second body to expose the second member; and filling the mold sealingly coupled to the portion of the second body with the second material, including filling the one or more recesses on the second body, to form the other handle of the pair on the portion of the second body.

3. The method of claim 2, further comprising:

forming first through holes on the first body, wherein only a subset of the first through holes are located on the portion of the first body, the first through holes of the subset of the first through holes formed prior to filling the mold sealingly coupled to the portion of the first body with the second material;

forming second through holes on the second body, wherein only a subset of the second through holes are located on the portion of the second body, the second through holes of the subset of second through holes formed prior to filling the mold sealingly coupled to the portion of the second body with the second material.

4. The method of claim 1, further comprising:

forming through holes on the body, wherein only a subset of the through holes are located on the portion of the body, the through holes of the subset of the through holes formed prior to filling the mold sealingly coupled to the portion of the body with the second material.

5. The method of claim 2, wherein the latch comprises an additional member of the first body, and wherein sealingly coupling the mold defining the first cavity to the portion of the first body to expose the first member further comprises sealingly coupling the mold defining the first cavity to the portion of the first body to expose the first member and the additional member of the first body.

6. The method of claim 5, wherein the second body includes an additional member to urge the second body in the other of the clockwise or counterclockwise direction, and wherein sealing coupling the mold defining the first cavity or the mold defining the second cavity to the portion of the second body to expose the second member further comprises sealing coupling the mold defining the first cavity or the mold defining the second cavity to the portion of the second body to expose the second member and the additional member of the second body.

7. The method of claim 2, further comprising:

forming a through hole in a region of the first body exposed by the mold sealingly coupled to the first body or in a region of the first body to be exposed by the mold to be sealingly coupled to the first body;

forming a through hole in a region of the second body exposed by the mold sealingly coupled to the second body or in a region of the first body to be exposed by the mold to be sealingly coupled to the second body;

the through holes for fastening the handles to a head of an end of a shaft assembly of the ambidextrous charging handle.

8. The method of claim 2, wherein the second body includes an additional member to urge the second body in the other of the clockwise or counterclockwise direction, and wherein sealing coupling the mold defining the first cavity or the mold defining the second cavity to the portion of the second body to expose the second member further comprises sealing coupling the mold defining the first cavity or the mold defining the second cavity to the portion of the second body to expose the second member and the additional member of the second body.

9. The method of claim 2, wherein the second mold interior is different than the first mold interior, and wherein the handle formed on the portion of the second body is longer than the handle formed on the portion of the first body.

10. The method of claim 2, wherein the first member includes a surface to contact a first end of the spring, and wherein the second member includes a surface to contact a second different end of the spring.

11. An apparatus comprising an overmold charging handle having dimensions including a total length and a total width, wherein the overmold charging handle comprises:

a shaft assembly including a first end to insert into a receiver of a firearm and a second end opposite the first end, the second end of the shaft assembly including a head, wherein a width of the head is less than the total width of the charging handle;

a latch to prevent movement of the shaft assembly away from the receiver when in a closed position; and a first material-cored handle fastened to the second end of the shaft assembly, the first material-cored handle comprising:

an exterior of a second material that is different than the first material, wherein the exterior exposes a section of a core of the first material-cored handle;

one or more through holes located on both sides of a border between the section of the core and the exterior of the second material, wherein the first material-cored handle is fastened to the second end of the shaft assembly using the one or more through holes of the section of the core.

12. The apparatus of claim 11, wherein:

the overmold charging handle comprises an overmold ambidextrous charging handle;

the first material-cored handle comprises one first material-cored handle of a pair of first material-cored handles of the overmold ambidextrous charging handle, and the core comprises a first core; and the one or more through holes located on both sides of the border of the section of the first core and the exterior of the second material comprise one or more first through holes located on both sides of the border of the section of the first core and the exterior of the second material of the first core, and the overmold ambidextrous charging handle further comprises:

the other first material-cored handle of the pair of first material-cored handles including a second core and an exterior that is of the second material and exposes a section of the second core;

one or more second through holes located on both sides of a border between the section of the second core and the exterior of the second material of the second core, wherein the other first material-cored handle of the pair of first material-cored handles is fastened to the second end of the shaft assembly using the second one or more through holes of the section of the second core.

13. The apparatus of claim 11, wherein the first material-cored handle forms an acute angle with the shaft assembly when the latch is in a closed position.

14. The apparatus of claim 13, wherein the first material-cored handle forms a greater acute angle with the shaft assembly when the latch is released.

15. The apparatus of claim 11, wherein the section of the core includes a member to urge the first material-cored handle in a clockwise or counterclockwise direction to hold the latch in the closed position.

16. The apparatus of claim 12, wherein the section of the first core includes a member to urge the first material-cored handle corresponding to the first core in a clockwise or counterclockwise direction to hold the latch in the closed position, wherein the section of the second core includes a member to release the latch.

17. The apparatus of claim 16, wherein the member of the second core is arranged to move the member of the first core to release the latch.

18. The apparatus of claim 16, further comprising a spring having a first end in contact with a surface of the member of the first core and a second end in contact with a surface of the member of the second core.

19. The apparatus of claim 18, wherein the second member is symmetric with the first member.

20. The apparatus of claim 16, wherein the second core comprises an additional member to urge the second handle in the other of the clockwise or counterclockwise direction, and the latch comprises an addition member of the first core.

21. The apparatus of claim 11, wherein the first material comprises metal, the first material-cored handle comprises a metal-cored handle, and the core of the metal-cored handle comprises a metal core, and wherein the second material comprises plastic and the exterior comprises a plastic exterior.

* * * * *